United States Patent [19]

Stipp

[11] Patent Number: 4,873,778

[45] Date of Patent: Oct. 17, 1989

[54] GUN BORE CLEANING APPARATUS

[76] Inventor: M. R. Stipp, P.O. Box 2613, Midland, Tex. 79702

[21] Appl. No.: 283,203

[22] Filed: Dec. 12, 1988

[51] Int. Cl.[4] ..... F41C 31/00

[52] U.S. Cl. ..... 42/95; 15/104.165

[58] Field of Search ..... 42/95, 96; 15/104.16, 15/104.165, 104.19, 104.18, 104.17

[56] References Cited

U.S. PATENT DOCUMENTS

| | | | |
|---|---|---|---|
| 41,481 | 2/1864 | Carr | 15/104.19 X |
| 182,352 | 9/1876 | Budd | 15/104.19 X |
| 2,131,676 | 9/1938 | Seifert | 15/104.16 |
| 2,559,376 | 7/1951 | Schnitger | 15/104.15 |
| 3,064,294 | 11/1962 | Stocking | 15/104.19 |
| 3,205,518 | 9/1965 | Romaine | 15/104.165 |
| 3,214,780 | 11/1965 | Sharpe | 15/104.19 X |
| 3,391,026 | 7/1968 | Leiser | 15/104.16 X |
| 3,536,160 | 10/1970 | Brewer | 42/95 |
| 4,291,477 | 9/1981 | Carlton | 42/95 |
| 4,497,082 | 2/1985 | Kogasaka | 15/104.165 |
| 4,547,924 | 11/1985 | Brygider | 42/95 X |

FOREIGN PATENT DOCUMENTS

| | | | |
|---|---|---|---|
| 3228986 | 2/1984 | Fed. Rep. of Germany | 42/95 |

*Primary Examiner*—Charles T. Jordan
*Assistant Examiner*—Michael J. Carone
*Attorney, Agent, or Firm*—John F. Booth; Gerald G. Crutsinger; Norman L. Gundel

[57] ABSTRACT

A swab for a shotgun having a cylindrical shaped disposable cleaning element removably mounted on a spindle. The cleaning element is made from a resilient closed cell polyethylene foam material having sufficient rigidity to dislodge contaminants from said bore, yet resilient enough not to score said bore. The element is mounted on a spindle with shoulders on the ends of the spindle to retain and compress the element at the ends.

10 Claims, 2 Drawing Sheets

GUN BORE CLEANING APPARATUS

BACKGROUND OF THE INVENTION

Cleaning the bore of a firearm after use is an essential maintenance step to prevent damage to the bore. Ammunition when fired will deposit contaminating material in the bore. If this material is left in place, it can attract moisture and cause corrosion and pitting.

The modern shotgun barrel can be considered to be divided, from breech to muzzle, into four components, i.e., chamber, forcing cone, cylinder and choke. The bore section with the greatest diameter is the chamber, which accepts the shell. For 12, 16, 20 and 28-gauge guns, it has been standardized in the United States at 2¾ inches in length with a slight tapering of diameter from the rear to front. In 12-gauge guns, for example, the chamber diameter at its greatest ranges from 0.800 inch to 0.816 inch, tapering forward to a minimum of about 0.796 inch at the rear portion of the forcing cone. In the forcing cone, the diameter then becomes restricted to about 0.729 inch - the standard diameter of the 12-gauge cylinder (variation in different guns may range from 0.725 inch to 0.735 inch). At the muzzle end of the 12-gauge shotgun barrel, a permanent, adjustable or replaceable choke then diminishes the bore diameter (no decrease for bore cylinder choke) to as small as 0.693 inch for full choke. The choke is the minimum bore diameter.

Shotgun ammunition contains in addition to gun powder and lead or steel shot, plastic packing. All these materials and the by-products of the chemical reaction of burning gun powder can be fused or otherwise deposited in the various parts of the bore. The inaccessibility of these contaminants within the bore coupled with the variations in bore diameter and the stubbornness of these contaminants to solvents and dislodgement presents a cleaning problem that has defeated many attempted solutions.

Prior bore cleaning equipment have utilized rubber backed emerys to dislodge materials from a bore. Carr U.S. Pat. No. #41,481. Metal screening has also been used. Stocking U.S. Pat. No. #3,064,294. Wire brushes have been used, either alone or in combination with absorbent patches of cloth, felt or other materials, for example, those shown in Schnitger U.S. Pat. No. #2,559,376 issued July 3, 1951. The use of wire brushes and other abrasives to dislodge contaminants in the bore is unacceptable for use with many expensive firearms because of the tendency to score or damage the bore.

Absorbent patches have been utilized to carry chemical solvents to inaccessible parts of the bore. The Romaine U.S. Pat. No. #3,205,518 issued Sept. 14, 1965 shows the use of a urethane patch and the Budd U.S. Pat. No. #182,352 shows a cylindrical wool patch. The Carlton U.S. Pat. No. #4,291,477 issued Sept. 29, 1981, shows the use of a spongeous cleaning patch. Patches when used alone are not capable of effectively dislodging fused materials. Patches tend to accumulate contaminants on their surface which act as a barrier to trap solvents within the absorbent body of the patch. If patches are packed within the barrel, their absorbency is reduced even though their ability to dislodge materials is increased. This packed patch configuration is shown in the Brygider U.S. Pat. No. #4,547,924 issued Oct. 22, 1985.

The Kogasaka U.S. Pat. No. #4,497,082 issued Feb. 5, 1985 uses a foamed urethane resin element with net woven cloth in the middle of various shapes. Unless this material is properly supported, it cannot provide proper cleaning properties.

SUMMARY OF THE INVENTION

According to the present invention, a cylindrical shaped disposable cleaning element is provided constructed from a closed cell polyethylene foam, a central opening extends through the cleaning element. A spindle is also provided for properly supporting the cleaning element on a cleaning rod. The spindle has a central cylindrical portion of a size corresponding to the central bore in the cleaning element whereby the cleaning element can be mounted on the cylindrical portion. A pair of annular shoulders are positioned at each end of the cylindrical portion for restraining the cleaning element and for compressing the ends of said cleaning element to form a dam or barrier for containing cleaning fluid on the element during the cleaning operation.

The present invention and the advantages and features thereof will be described in reference to the accompanying embodiment as set forth in the specification and drawings appended hereto while the scope of the invention and its coverage will be defined in the claims.

BRIEF DESCRIPTION OF THE DRAWING

For a full understanding of the invention, reference should be had to the following detailed description taken in conjunction with the accompanying drawings in which.

DETAILED DESCRIPTION

Figure 1:
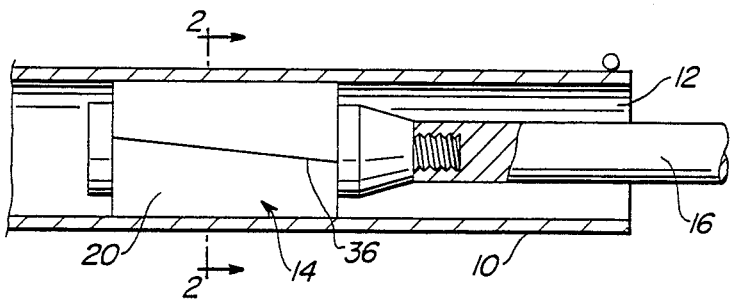
FIG. 1 is a sectional view of a bore of a gun with the improved cleaning element of the present invention shown installed therein affixed the end of a cleaning rod.

Referring now to the drawings wherein like reference characters designate like or corresponding parts throughout the several views there is illustrated in FIG. 1 a sectional view of a shotgun barrel 10 having a bore 12 with the improved cleaning device 14 of the present invention inserted therein. The cleaning device 14 is shown threaded onto a conventional cleaning rod 16. The cleaning rod 16 preferably is constructed of nonmetallic material to prevent metal contact with the barrel and is of sufficient strength to axially reciprocate the cleaning device 14 through the barrel during the cleaning operation. The cleaning device 14 comprises a spindle assembly 18 and a disposable cleaning element 20.

Figure 3:
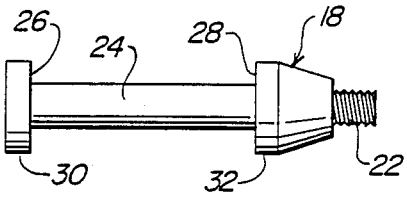
FIG. 3 is a side elevation view of the spindle of one embodiment of the spindle assembly with the cleaning element removed therefrom.

The spindle assembly 18 is best shown in FIG. 3 as having a threaded portion 22 on one end thereof. Threaded portion 22 is selected to mate with corresponding threads on the cleaning rod 16 to attach the spindle to the cleaning rod 16. The spindle can be pulled back and forth through the bore 12 during the cleaning operation. It can be understood, of course, that threads 22 could be replaced with an eyelet or the like and a cord could be used to pull the cleaning device 14 through the bore.

Figure 2:
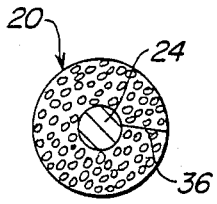
FIG. 2 is a sectional view taken on line 2—2 of FIG. 1 looking in the direction of the arrows.

Spindle 18 has a central body 24 which is cylindrical in cross section (see FIG. 2). Body 24 is bordered by a pair of radially extending shoulders 26 and 28. Shoulders 26 and 28 each terminate in cylindrical guide portions 30 and 32, respectively. These enlarged shoulders 30 and 32 are axially extending and as will be described in more detail hereinafter, they are of a set diameter smaller than the bore of the gun to be cleaned. In the preferred embodiment, the spindle is constructed from a non-metallic material such as plastic to prevent damage to the gun barrel.

The cleaning element 20 is best shown in FIGS. 1 and 2 as comprising a cylindrical body of polyethylene foam material such as closed cell "Ethafoam #202 Plank."- "Ethafoam" brand plastic foam is supplied by the Dow Chemical Company, Midland, Michigan. This material is closed celled and has sufficient compressive and tear strength to be ideal for use to dislodge material from the bore during cleaning. Other closed cell materials could be used. A compressive strength for other materials in the range of about 4 to 26 psi is acceptable while a range of about 7 to 17 psi is preferred. A tear strength of about 14 to 21 lb/in is acceptable while about 15 lb/in is preferred. The material has an acceptable density in the range of 1.9 to 6.6 pcf while 2.2 pcf is preferred.

The cylindrical body of element 20 has an axially extending bore 34 of a size corresponding to the central body portion 24. The axial length of the cylindrical body of element 20 also corresponds to the axial length of the central body 24. An axially extending slit 36 is formed in the element 20 to allow the element 20 to be mounted on the spindle 18. Preferably, the slit 36 is slightly angled as shown in FIG. 1.

Figure 4:
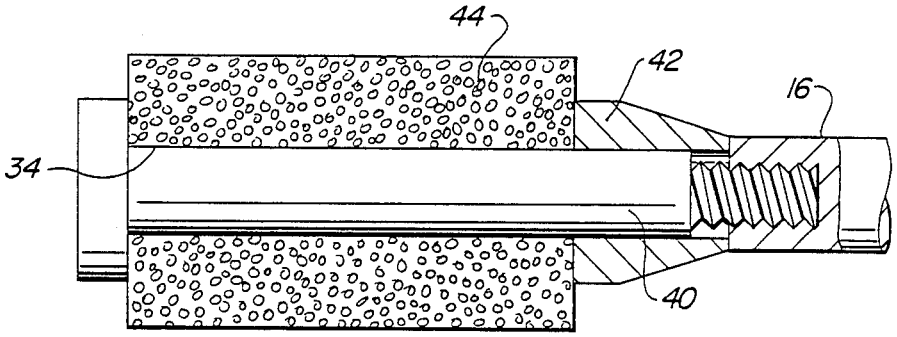
FIG. 4 illustrates a partial sectional view of a second embodiment of the cleaning element of the present invention.

In FIG. 4, an alternative configuration is shown. In this configuration the spindle is constructed from two parts 40 and 42. The cleaning element 44 comprises a hollow cylindrical element without the slit 36 therein. The assembly of the cleaning element 44 on the spindle is accomplished by disassembling the two pieces 40 and 42 inserting the cleaning element over the piece 40 and thereafter inserting the piece 40 through the piece 42 and threading it onto the cleaning rod 16 as shown in FIG. 4.

According to the present invention, the improved cleaning element provides both the scouring and swabbing functions of prior cleaning elements by use of properly supported polyethylene foam. First, it is desirable to use polyethylene foam which is of a closed cell type such that any solvent or liquids which are applied to the exterior of the foam will be trapped in the porous openings on the surface and will not soak into the interior cleaning element where it is wasted. Second, the cleaning element 20 is constructed such that it is larger than the bore 12. Thus the element 20 when inserted in the bore will be slightly compressed and when properly supported will provide the scouring and dislodgement function of a wire brush without the damaging effects. Compression in a range of 25 to 15% is preferred for "Ethafoam 220 Plank" material.

For example, for a thorough cleaning operation, the cleaning swab for a 12-gauge shotgun must sweep through the varying diameters of the bore, i.e., from a chamber maximum of about 0.816 inch to a constriction of 0.693 inch minimum diameter in a full choke. An optimum swab size "Ethafoam 220 Plank" material is about 0.90 inch, which would result in 9% compression in the shell chamber and up to 23% compression in the full choke minimum restriction. Swab length is not a critical parameter, but 1½to 2 inches appears to be a convenient dimension for most shotgun gauges.

Figure 5:
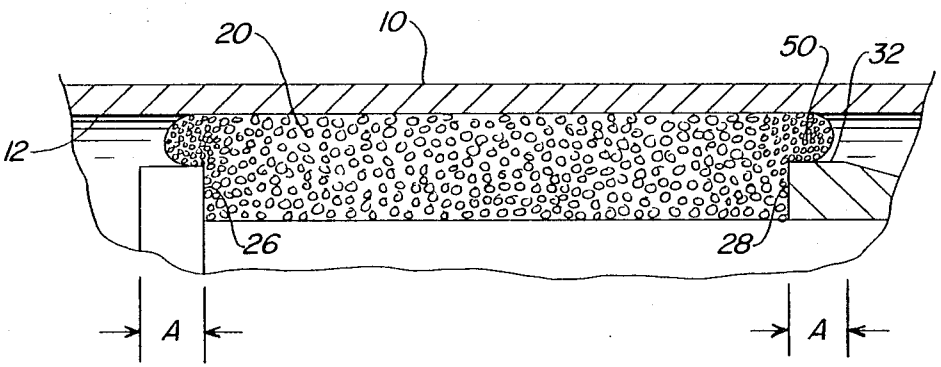
FIG. 5 is an exploded sectional view of the clearance between the bore and the shoulder portion of the cleaning device of the present invention.

The axial length of the enlarged guide surface 32 is represented in FIG. 5 by dimension "A." "A" is selected to be sufficient to force the cleaning element 20 to be compressed to a greater extent between the guide surface 32 and the bore 12 as shown. This additional compressed portion 50 extends circumferentially around the surfaces 30 and 32. Portion 50 will provide the dual function of preventing contact between the spindle and the barrel and also provides an O-ring shaped wiper at each end of the spindle to trap solvents between the ends thereof.

In operation, cleaning device 14 of the present invention is first installed on a cleaning rod 16 and solvent oil or other liquid to be deposited on the interior of the barrel 10 is applied to the exterior cleaning element 20. The open cells on the surface of the polyethylene foam material act as numerous bubble shaped reservoirs for the liquid. The assembly is then inserted into the barrel, the cleaning element being compressed onto the spindle with seals or wipers 50 formed at either end of the element. When areas 50 are compressed, compacted "O-rings" are formed to dislodge solid materials fused on the wall of the bore while simultaneously trapping the solvent or other cleaning liquids between the two ends of the spindle as the cleaning element is reciprocated in the barrel. In other words, a reservoir of liquid is formed on the surface of the cleaning element and is trapped between the ends of the spindle by the compressed portions 50 while the cleaning element is reciprocated back and forth through the bore. The microscopic open pores on the surface of the cleaning element also act to retain dislodged material which in turn displaces the cleaning liquids during the cleaning operation.

The above process can be repeated with disposable cleaning elements and with the final step of using an element to oil the barrel.

Although the swab has been described in reference to shotguns, it can be easily adapted to other types of firearms. With regard to pistol and rifle barrels, the decrease in bore diameter from breech to muzzle is quantitatively minimal. Maintenance of the desired force for reciprocating movement could best be accomplished by utilizing a less-compressive foam material, such as polyethylene of density 3.8 lb/cu ft, which would require approximately 14 psi to achieve 25% compression. Spindle and cleaning rod dimensions would necessarily be tailored to the smaller bore size.

It is to be understood that the foregoing relates only to the preferred embodiments of the present invention and that numerous alterations, modifications and changes can be made in the present invention without departing from the spirit and scope of the invention as set forth in the appended claims.

What is claimed is:

1. A swab assembly for connection to a cleaning rod or the like, for use with a cleaning rod or the like in cleaning the bore of a shotgun, said assembly comprising:

a spindle constructed from rigid material and a cleaning element removably mounted thereon, said cleaning element having a cylindrical exterior surface and a central bore extending axially therethrough, said cleaning element being constructed of polyethylene closed cell foam and being of a greater diameter than the bore of said gun, said spindle having a central cylindrical portion for receiving said cleaning element, said cylindrical portion being of a size to extend through the central bore in said cleaning element, a pair of spaced annular shoulders at opposite ends of said central portion, said shoulders being spaced apart to correspond to the axial length of said cleaning element, each of said shoulders terminating in a cylindrical guide surface extending axially in a direction away from said central position, each of said shoulders being small enough in diameter to slide axially through the bore and being smaller in diameter than said cleaning element.

2. The swab assembly of claim 1 wherein said cleaning element has a diameter at least about 25% greater than the minimum bore diameter.

3. The swab assembly of claim 1 wherein said cylindrical guide surfaces each extend axially from the central portion to form an annular wiper at each end of the swab.

4. The swabs assembly of claim 1 additionally comprising connection means comprising threads adjacent one end of said spindle for mating engagement with threads on a cleaning rod or the like.

5. The swab assembly of claim 4 wherein said shoulder adjacent said threads is removably attached to said spindle to allow installation of said cleaning element on said spindle.

6. The swab assembly of claim 1 wherein said cleaning element has a slit radially extending through its side wall whereby said cleaning element can be mounted on said spindle.

7. The swab assembly of claim 1 wherein said cleaning element has a compressive strength in the range of about 4 to 26 psi and tear strength in the range of about 14 to 21 lb/in.

8. The swab assembly of claim 1 wherein said cleaning element has a tear tensile strength of about 15 lb/in.

9. The swab assembly of claim 8 wherein said cleaning element has a tear tensile strength of about 15 lb/in.

10. The swab element of claim 1 wherein said cleaning element has a tear tensile strength of about 15 lb/in.

* * * * *